United States Patent [19]

Curtius et al.

[11] 4,212,648

[45] Jul. 15, 1980

[54] PROCESS FOR THE PRINTING OF CELLULOSE FIBER FABRICS

[75] Inventors: Horst Curtius, Kelkheim; Erich Feess, Hofheim am Taunus; Willy Gronen, Schöllkrippen, all of Fed. Rep. of Germany

[73] Assignee: Hoechst Aktiengesellschaft, Frankfurt am Main, Fed. Rep. of Germany

[21] Appl. No.: 940,400

[22] Filed: Sep. 7, 1978

[30] Foreign Application Priority Data

Sep. 9, 1977 [DE] Fed. Rep. of Germany ..... 2740679

[51] Int. Cl.[2] ..... C09B 27/00; D06P 1/02

[52] U.S. Cl. ..... 8/466; 8/449; 8/519; 8/476

[58] Field of Search ..... 8/71, 62, 63, 74

[56] References Cited

U.S. PATENT DOCUMENTS

| | | | |
|---|---|---|---|
| 189,371 | 4/1877 | Mather | 8/74 |
| 2,514,410 | 7/1950 | Olpin et al. | 8/63 |
| 3,140,914 | 7/1964 | Ward et al. | 8/24 |
| 3,597,144 | 8/1971 | Leddy | 8/74 |
| 3,708,257 | 1/1973 | Lowenfeld et al. | 8/21 C |
| 3,713,767 | 1/1973 | Lowenfeld et al. | 8/21 C |
| 3,787,179 | 1/1974 | Lowenfeld | 8/71 |
| 3,961,887 | 6/1976 | Gronen et al. | 8/71 |
| 4,052,157 | 10/1977 | Fuchs et al. | 8/71 |
| 4,094,637 | 6/1978 | Feess et al. | 8/71 |

FOREIGN PATENT DOCUMENTS

| | | | |
|---|---|---|---|
| 14950 | 11/1880 | Fed. Rep. of Germany . | |
| 7113828 | 4/1972 | Netherlands | 8/71 |
| 525099 | 8/1940 | United Kingdom | 8/71 |

*Primary Examiner*—Ronald W. Griffin

*Attorney, Agent, or Firm*—Curtis, Morris & Safford

[57] ABSTRACT

Process for printing textile cellulose fiber fabrics with printing pastes containing coupling components dissolved in an alkaline medium, sodium nitrite and diazotizable primary aromatic amines, in which process the amines are used as a solution or in the form of an aqueous fine dispersion with a particle size of less than 0.03 mm and are selected in a manner such that they are paractically non-volatile under at the drying temperatures and show a minimum basicity degree with the $pK_a$ being 2.2 or more, developing the water-insoluble azo dyestuffs on the fiber by diazotizing the amines and coupling the diazonium compound formed with the coupling components following the drying of the printing pastes applied by a treatment of the printed fabrics at room temperature with an aqueous developing bath containing formic acid, and completing the coupling without a previous intermediate drying of the fabric, however, optionally following an air passage, by a short-time steaming with saturated steam.

2 Claims, No Drawings

PROCESS FOR THE PRINTING OF CELLULOSE FIBER FABRICS

The present invention relates to a process for the printing of cellulose fiber fabrics.

In German Patent Specification No. 14 950 (GräBler, 1880) a process has been described in which a coupling component (β-naphthol), a diazotizable primary aromatic amine (xylidine) and sodium nitrite are printed together from a printing paste on cotton in the presence of ammonium salts of strong acids as acid-yielding agents, and this print is developed by steaming, in which process the diazotization of the amine and then the coupling of the diazonium compound formed with the β-naphthol are effected under the influence of the remaining acid after the escaping of ammonia due to hydrolysis.

In recent times this "all-in" principle has been realized, while using "finished" products without an incorporated acid-yielding agent, with alkaline printing pastes, and subsequently developing the azo dyestuff by way of an acid passage as a "two phase" process, by which method coupling components dissolved in an alkaline medium, finely dispersed bases and sodium nitrite are printed together from a printing paste onto a cellulose fiber fabric, and following the drying of the textile goods in the mansarde the developing of the insoluble azo dyestuff is effected by diazotization of the amine and coupling of the diazonium compound thus produced with the coupling component by way of an acid passage, for example by overpadding or slop-padding, spraying or other methods.

In this process non-volatile organic acids were mostly used, such as lactic acid, tartaric acid, oxalic acid, glycolic acid or mixtures thereof, and the possibility of using inorganic acids, such as phosphoric acid, volatile inorganic acids, such as hydrochloric acid, and acid salts of inorganic acids, such as sodium hydrogenosulfate, was considered (lit: Feess, E., Textil-Praxis International, 1976, vol. 11, pages 1307 to 1318 and vol. 12, pages 1423 to 1427).

In this process, difficulties with regard to the yield and the reproducibility of the azo dyestuff were quite evident, and there was also risk of fiber damage in the unprinted portions. Tests have shown that for reasons of the local concentration and pH conditions either the diazotization (not enough acid), or the coupling (too much acid) were incomplete. In this manner it was not possible to reach optimum results; however, when using monochloroacetic acid as developing agent, useful results were actually obtained. Nevertheless, under these conditions a considerable development of nitrous gases from the excess nitrite cannot be avoided.

The use of volatile organic acids proved to be impossible, since unsubstituted monocarboxylic acids having 2 or more carbon atoms show an insufficient degree of dissociation and are therefore not acid enough; the stronger formic acid, however, was not considered applicable due to its known reducing effect on nitrous acid.

When developing azo dyestuffs in a steamer atmosphere that has been saturated with vapors of acetic acid and their homologues, the formation of nitrous gases is actually reduced and there is no fiber damage, either, but the dyestuff yield is insufficient because of incomplete diazotization, and the color shades are not reproducible.

It has now been found that fabrics of cellulose fibers can be printed with water-insoluble azo dyestuffs formed on the fiber, if printing pastes are employed which contain coupling components (C.I.: Azoic Coupling Components) dissolved in an alkaline medium, sodium nitrite and diazotizable primary aromatic amines (C.I.: Azoic Diazo Components), said amines being present as a solution or in the form of an aqueous fine dispersion with a particle size of less than 0.03 mm and being selected according to the invention in a manner that they are practically nonvolatile under the drying temperatures and show a minimum basicity degree with the $pK_a$ being 2.2 or more. The development to yield the azo dyestuff is effected according to the invention, following the drying of the applied printing paste (via the diazotization of the amine and the coupling which takes place almost simultaneously) by a treatment of the printed textile material at room temperature with an aqueous developing bath containing formic acid in an amount corresponding to 10 to 100 g/l of a 85% formic acid. By way of a short passage in a high-temperature steamer, into which the material is introduced without previous intermediate drying, however, optionally after an air passage of up to 10 seconds, the coupling is completed. Steaming is performed for 3 to 20 seconds at 100° to 130° C. in order to complete the formation of the azo dyestuff by coupling. In this process the steaming period may be prolonged without any disadvantage. However, preference is given to shorter steaming periods of up to 10 seconds, since this involves a saving of energy and the result of the dyeing reaches an optimum. After steaming, the dyeing is completed in usual manner.

According to the process of the invention clear and reproducible color shades and depths are obtained on the cellulose fiber fabric which correspond to the amounts employed of the dyestuff-forming components.

In the process of the invention there is neither damage to the fibers, nor an undesired development of nitrous gases. Because of the requirement to expose the fabrics treated with acid to high temperatures, the use of non-volatile acids for cellulose fibers is not possible. As a matter of fact, if said acids were used, a buffer mixture would be formed on the printed areas because of the presence of alkali in the printing paste under normal conditions, the buffer mixture preventing fiber damage, but in the unprinted areas a carbonization of the cellulose would take place during the steaming process.

It was an extremely surprising fact, which could not have been foreseen, that formic acid can be employed excellently for the development of azo dyestuffs, from the components printed on the material, with special consideration being given to the dyestuff yield and the reproducibility as the criteria, and that in the process according to the invention the annoying, undesired nitrous gases, which may even be hazardous to the health of persons exposed to them, were found only to an insignificant degree.

It was necessary to overcome the experts' prejudice resulting from the knowledge that formic acid and nitrous acid destroy each other, thus neutralizing their activity. However, the reaction proceeds evidently at a lower rate and therefore preferably following the diazotization process and especially in the steamer at elevated temperatures, which involves another advantage. The excess amount of formic acid is not only reduced by its volatility, but alsio by its oxidation to give $CO_2$, which favors the coupling. The remaining nitrous acid is reduced for the most part in the vapor phase to give dinitrogen oxide and nitrogen.

As thickening agents for the printing pastes there are mentioned starch ethers, bean flour ethers, guaranates, alginates and the mixtures thereof.

For the process of the invention there may be used those diazotizable primary aromatic amines (fast color bases) which meet the following requirements: They are not to show any, or only a very slight volatility under drying conditions, they must be present in the form of a solution or aqueous fine dispersions with a particle size of less than 0.03 mm, and they must show a minimum basicity degree (expressed by the $pK_a$ value being equal to, or above, 2.2).

According to the invention, the following products are suitable, for example, while maintaining the above-mentioned required standard:

| Azoic Diazo Component | C.I. No. |
|---|---|
| 132 | 37 111 |
| 29 | 37 140 |
| 31 | 37 145 |
| 42 | 37 150 |
| 14 | 37 151 |
| 24 | 37 155 |
| 43 | 37 160 |
| 41 | 37 165 |
| 40 | 37 170 |
| 20 | 37 175 |
| 15 | 37 180 |
| 4 | 37 210 |
| 27 | 37 215 |
| 48 | 37 235 |

In combination with the coupling components a great number of color shades having favorable fastness properties on cellulose are possible.

The diazotizable primary aromatic amines have a more or less strongly pronounced basic character, i.e. with acids they can form salt-like addition compounds ("salts"). The higher (more pronounced) the basicity of an amine, the stronger is its tendency to form salts also with weaker acids, without hydrolysis taking place. The forming of these salts is one of the preconditions for the realization of a diazotization and for its complete development.

As the process of the invention operates with formic acid, a minimum basicity is required.

Aromatic amines whose basicity is too low are not appropriate for the process of the invention; they could only be diazotized with strongly dissociated mineral acids in excess concentrations, since otherwise hydrolysis will take place.

The degree of basicity may be expressed by the value $pK_a$. The $pK_a$ value is defined as negative decimal logarithm of the dissociation constant of the base (the amine) in the molar equilibrium with its own salt of a strong acid, i.e. a high $pK_a$ value indicates a high basicity.

For the process of the invention, a minimum basicity of the amines with the $pK_a$ being equal to, or above, 2.2 is required.

Literature with regard to the $pK_a$ value: Handbook of Chemistry and Physics, CRC-Press, Cleveland, Ohio. Fieser L. F. & Fieser M., Organic Chemistry, 3rd edition 1956, page 597, New York. Perrin, D. D. Dissociation Constants of Organic Bases in Aqueous Solution, Butterworth, London.

For the development of these prints by diazotization and coupling an acid treatment is generally required.

In this process the acid has several functions: It serves to neutralize the alkali in the printing paste, to adjust the optimum coupling range in the acid medium, to form the salt of the amine to be diazotized, and to free the nitrous acid $HNO_2$ from the sodium nitrite.

If for this purpose there are used non-volatile, strong organic acids, acid salts of an inorganic acid, such as sodium hydrogenosulfate, or even mineral acids, the conditions are favorable for the diazotization, however, unfavorable for the coupling, since the coupling range frequently falls short of the optimum value (too acid). Fiber damage of the cellulose, especially in the unprinted places, cannot be avoided in the drying or steaming processes. Nitrous gases are formed in detrimental amounts.

When using the volatile weak acetic acid, no fiber damage is indeed to be expected, however, the conditions for the diazotiztion are not optimum, which adversely affects the dyestuff yield.

In the case of mixtures of non-volatile strong and volatile weak organic acids the strong acids are first partially neutralized; the dyeing result then depends on which acid, and what amount thereof, remains in the free state at the printed places.

Because of its specific properties, formic acid as developing medium, however, meets the requirements of the process of the invention: It is dissociated to a sufficiently high degree, in order to be suitable to react also with amines of a relatively low basicity while forming stable (non-hydrolyzing) salts. It forms with the sodium formate an active buffering system, having been obtained by the neutralization of the alkali of the printing paste an which maintains the coupling capacity of the coupling component in the acid range for the period of dyestuff formation, by which measure even fluctuations in the vapor temperature are not detrimental to the constancy of the color shade. It is volatile, which excludes fiber damage of the cellulose at elevated temperatures. Finally, it contributes to the fact that nitrous gases are formed to a much smaller extent than with other acids.

Formic acid reacts at elevated temperature (also in the vapor phase) with excess nitrous acid, in which process the two acids consume each other. Laboratory tests and analyses have shown that in the reaction there are predominantly formed carbon dioxide, di-nitrogen oxide $N_2O$, nitrogen, water vapor as well as a portion of NO. This reaction develops at a later stage or at a lower rate than the diazotization. Besides, in the course of this process a shift of the pH value takes place towards the neutral point, which is advantageous for the coupling.

The following Examples serve to illustrate the invention.

EXAMPLE 1

(1) A coupling component, Azoic Coupling Component 2 (C.I. No. 37 505), is dissolved in common manner according to the cold vatting method, however, without the usual addition of formaldehyde. For this purpose, a mixture of 50 g of denatured ethanol,
25 g of 32.5% sodium hydroxide solution and
75 g of water of 40° C. is poured over
50 g of said coupling component, and the mixture obtained is stirred to give a clear solution 200 g.

(2) A diazo component (undiazotized primary aromatic amine), Azoic Diazo Component 41 (C.I. No. 37 165), present in the form of a fine-grained 40% aqueous dispersion, is stirred with water at room temperature:

125 g of said diazo component (40% strength) and
125 g of water of 20° C.
250 g.

The solution (1) of the coupling component thus prepared and the suspension of the diazo component (2) are stirred with a stirrer one after the other into a stock thickening consisting of 30 g of thiodiglycol,
10 g of 32.5% sodium hydroxide solution,
20 g of an aqueous sodium nitrite solution (1:2),
200 g of an aqueous starch ether solution of 10% strength, combined with
200 g of a 4% aqueous solution of a highly viscous sodium alignate and
90 g of water or a thickening mixture as above, to give a total of
100 g and the mixture obtained is homogenized.

With this printing paste, a bleached cotton fabric is printed by way of machine printing and dried in a mansarde.

By means of a slop-padding device arranged immediately before an Arioli steamer, the printed fabric is then slop-padded in a bath at 20° C. containing 50 $cm^3$ of 85% formic acid per liter and is immediately introduced into the steamer. The developing of the azo dyestuff by diazotization of the base and the coupling of the diazonium compound formed with the coupling component starts immediately upon contacting the fabric with the acid bath solution and is completed after its passage into the superheating zone of the steamer within a very short time (6 seconds at 108° C.). If due to the apparatus used a longer dwelling in the hot zone is required, there is no influence on the dyestuff yield. As a result, a deep violet print on white background is obtained.

In the following Table there further Examples are given, the process being carried out in a manner analogous to that of Example 1. The process admits of a great number of possible combinations, i.e. it is not limited to these Examples.

| Example | g/kg | Azoic Coupling Component | C.I. No. | g/kg | Azoic Diazo Component 40 % dispersion | C.I. No. | Color shade |
|---|---|---|---|---|---|---|---|
| 2 | 50 | 14 | 37 558 | 125 | 132 | 37 111 | scarlet |
| 3 | 60 | 4 | 37 560 | 75 | 20 | 37 175 | navy |
| 4 | 50 | 20 | 37 530 | 125 | 132 | 37 111 | scarlet |
| 5 | 50 | 24 | 37 540 | 125 | 42 | 37 150 | red |
| 6 | 100 | 15 | 37 600 | 125 | 42 | 37 150 | brown |
| 7 | 50 | 5 | 37 610 | 62.5 | 14 | 37 151 | yellow |
| 8 | 100 | 13 | 37 595 | 75 | 14 | 37 151 | black |

What is claimed is:

1. A process for the printing of textile cellulose fiber fabrics, in which printing pastes containing coupling components, dissolved in an alkaline medium, sodium nitrite and diazotizable primary aromatic amines are printed on said fabrics, allowed to dry and thereafter the water-insoluble azo dyestuffs are developed on the fibers by diazotizing the amines and coupling the diazonium compounds formed with the coupling components, which comprises developing azo dyestuffs from an amine in a solution or in the form of aqueous fine dispersions wherein the amine has a particle size of less than 0.03 mm, said amines being practically non-volatile under the drying temperatures and showing a minimum basicity degree as measured by $pK_\alpha$ of 2.2 or more, said developing being effected so as to give the azo dyestuffs, following the drying of a printing paste applied by a treatment of a printed fabric, at room temperature, with an aqueous developing bath containing formic acid in an amount corresponding to 10 to 100 g/l of an 85% formic acid, and thereafter completing the coupling without a previous intermediate drying of the fabric, by a passage through a steamer for 3 to 20 seconds, at a temperature in the range of from 100° to 130° C.

2. The process as defined in claim 1, wherein, preceding a passage through a steamer, said printed fabric is exposed to air for a period of about 10 seconds.

* * * * *